US008766761B2

(12) United States Patent
Schwabenland

(10) Patent No.: US 8,766,761 B2
(45) Date of Patent: Jul. 1, 2014

(54) ROCKER SWITCH UNIT WITH FUSE

(75) Inventor: Wolfgang Schwabenland, Hanau (DE)

(73) Assignee: Schaffner EMV AG, Luterbach (CH)

( * ) Notice: Subject to any disclaimer, the term of this patent is extended or adjusted under 35 U.S.C. 154(b) by 95 days.

(21) Appl. No.: 13/118,946

(22) Filed: May 31, 2011

(65) Prior Publication Data

US 2011/0227692 A1 Sep. 22, 2011

Related U.S. Application Data

(63) Continuation of application No. PCT/EP2008/068009, filed on Dec. 19, 2008.

(51) Int. Cl.
*H01H 85/02* (2006.01)

(52) U.S. Cl.
USPC ..... 337/143; 337/10; 337/142; 337/144; 337/156; 337/37; 337/59; 337/60; 337/66

(58) Field of Classification Search
USPC ..... 337/10, 37, 59, 60, 66, 142–144, 156
See application file for complete search history.

(56) References Cited

U.S. PATENT DOCUMENTS

| | | | | |
|---|---|---|---|---|
| 3,800,259 | A | 3/1974 | Humphreys | |
| 4,292,616 | A * | 9/1981 | Andersen | 337/4 |
| 4,298,854 | A | 11/1981 | Andersen | |
| 5,559,662 | A * | 9/1996 | Happ et al. | 361/104 |
| 5,831,228 | A * | 11/1998 | Kuki et al. | 200/16 E |
| 6,327,140 | B1 * | 12/2001 | Hashizawa et al. | 361/642 |
| 6,366,449 | B1 * | 4/2002 | Hashizawa et al. | 361/642 |
| 6,407,656 | B1 * | 6/2002 | Konda et al. | 337/194 |
| 6,587,028 | B2 * | 7/2003 | Mollet et al. | 337/194 |
| 6,717,505 | B1 * | 4/2004 | Bruchmann | 337/194 |
| 6,727,797 | B1 * | 4/2004 | Bruchmann | 337/210 |
| 6,734,580 | B1 | 5/2004 | Bruchmann | |
| 6,759,939 | B2 * | 7/2004 | Sudan et al. | 337/211 |
| 6,784,783 | B2 * | 8/2004 | Scoggin et al. | 337/194 |
| 6,998,954 | B2 * | 2/2006 | Milanczak | 337/194 |
| 7,355,503 | B2 * | 4/2008 | Buettner | 337/211 |
| 7,474,194 | B2 * | 1/2009 | Darr et al. | 337/72 |
| 7,495,540 | B2 * | 2/2009 | Darr et al. | 337/72 |
| 7,924,136 | B2 * | 4/2011 | Darr et al. | 337/72 |
| 7,932,804 | B2 * | 4/2011 | Buettner | 337/196 |
| 7,982,578 | B2 * | 7/2011 | Buettner | 337/196 |
| 2006/0125596 | A1 * | 6/2006 | Darr et al. | 337/194 |

FOREIGN PATENT DOCUMENTS

| | | |
|---|---|---|
| DE | 9403879 U1 | 5/1994 |
| EP | 0690527 A1 | 1/1996 |
| EP | 0616352 B1 | 4/1997 |
| FR | 2191234 A1 | 2/1974 |

(Continued)

*Primary Examiner* — Anatoly Vortman
(74) *Attorney, Agent, or Firm* — Blank Rome LLP

(57) ABSTRACT

A rocker switch unit (1) with fuse comprising a housing (2); a rocker switch (3) lodged pivotally in the housing (2); at least a fuse lodged in the housing (2) and at least two connection elements (9) for connecting the rocker switch unit (1) with an external apparatus, wherein the two connection elements (9) are connected to each other by the fuse, when rocker switch (3) is in an ON-position. According to the invention the housing (2) provides at least one blind hole (4) for accommodating the fuse, wherein one terminal of the fuse serves as a first connection element for connecting the rocker switch unit (1) with the external apparatus. The rocker switch unit 1 can be used in any apparatus, in a network filter or as IEC entry plug.

16 Claims, 4 Drawing Sheets

(56) References Cited

FOREIGN PATENT DOCUMENTS

| | | | |
|---|---|---|---|
| FR | 2431762 | A1 | 2/1980 |
| FR | 2499761 | A3 | 8/1982 |
| GB | 2011722 | A | 7/1979 |
| JP | 07050119 | A | 2/1995 |

* cited by examiner

ROCKER SWITCH UNIT WITH FUSE

FIELD OF THE INVENTION

The present invention concerns a rocker switch unit with fuse. The inventive rocker switch unit as disclosed herein can be used in any apparatus, in a network filter or as IEC entry plug.

DESCRIPTION OF RELATED ART

Switches with a fuse are widely known in the prior art. Examples of such embodiments are given.

FR2499761 discloses a bipolar switch provided with a fuse which comprises a modular body presenting two housings for the bipolar switch and a housing including a fuse holder which can have different dimensions. Two contacts face two terminals used for connection to a neutral feeder line wire. A second feeder wire (phase wire) is connected to the terminal and to the terminal of the fuse holder.

FR2431762 discloses a circuit breaker with a selecting prong presenting a cavity used for housing a fuse cartridge. This circuit breaker is intended for placement on phase conductors of single-phase installations.

EP0690527 discloses a connector for a single phase cable which is used with a power supply network and has a plastic housing with removable covers. The top side of the housing has flat conductors engaging with projecting finger contacts with forked ends that can latch onto conductors. The base has screw terminals that receive the cables. A fuse is used to link cable ends to the conductors. A removable cover is provided on one side of the housing allowing an easy access to the HRC fuse.

U.S. Pat. No. 3,800,259 discloses a housing which has a pair of spaced first and second contact members for respectively being interconnected in a desired electrical circuit, whereby the electrical circuit will not be completed unless the contact members are electrically interconnected together. A manually movable fuse member is carried by the housing and has one operating position (relative to the housing) in which the fuse member makes electrical contact between the contact members so that the fuse member completes the circuit and so that the circuit will be fused by the fused member. The fuse member when moved to another operating position (relative to the housing) will break electrical contact between the contact members to open the circuit, whereby the fuse member also acts as a manually operable switch for the electrical circuit.

U.S. Pat. No. 6,734,580 relates to a fused switch unit with a housing and switching rocker, which is mounted in the housing of the fused switch unit such that it can pivot in both directions between a switched-on position and a switched-off position. The fused switch unit has apparatuses for monitoring the circuit and has an indicator for monitoring the serviceability of a fuse link, with the indicator being arranged in the switching rocker. The indicator is preferably configured to provide an optical indication.

FR2191234 discloses a switch with a body, in which a fuse is inserted. The body has to be removed in order to change the body. DE9403879U discloses a similar embodiment.

U.S. Pat. No. 4,298,854 discloses a combined cartridge fuse holder and switch which employs a novel switching mechanism including a pair of spaced bars arranged in a first plane and positioned adjacent an inclined ramp. A contact pin is mounted in a switch arm, which in turn is pivotally mounted so that the pin can be moved from an OFF position in which the pin rests on the inclined ramp to an ON position in which the pin rests on and bridges the contact bars. One of the contact bars is electrically coupled to a first terminal while the other of the contact bars is electrically coupled through a fuse to a second terminal.

The disadvantage of these switches is that too many mechanical parts are involved. Too many mechanical parts lead not only to higher production costs per part, but to an increase in the danger of failure of each of these parts. Additionally, especially where the fuse is inside the switch the fuse cannot easily be replaced. Another drawback of these switching units comes from the fact that many of them cannot be removed as an entire unit, but are connected to the apparatus. In case of failure of the switching unit, it is not easy to remove the switching unit in order to repair the switch. Another drawback comes from the fact that the switches are too big and space consuming.

BRIEF SUMMARY OF THE INVENTION

The present invention aims to provide a rocker switch unit which avoids the drawbacks of the prior art.

It is therefore the aim to provide a rocker switch unit with less mechanical parts than known switches of the prior art and with a switch body which is simpler than the embodiments known in the prior art.

It is another aim to produce a rocker switch unit which can easily be removed from any apparatus so as to change the fuse or the entire unit for example.

It is another aim to provide a rocker switch unit which is less space consuming than the models known from the prior art.

According to the invention, these aims are achieved by means of a rocker switch unit characterized in that the housing provides at least one blind hole for accommodating the fuse, wherein one terminal of the fuse serves as a first connecting element for connecting the rocker switch unit with an external apparatus.

Advantageously, the fuse can be held inside the blind hole by a spring and a fuse holder. Below the rocker switch, a base can be provided which is geared on two sides by a spring and a ball bearing, the ball bearing switches a switch connecting element to connect two connecting elements, when the rocker switch is in the ON-position.

The housing provides on the upper side, where the rocker switch is pivotally lodged, on each lateral side, two lateral walls which are separated by a slot. The two lateral walls are connected separately to the lower part of the housing. The rocker switch is pivotally fastened on two opposed lateral sides to the two inner walls of the housing by means of knobs, whereby the inner walls have corresponding circular apertures. The assembly of the inner parts, including the connection elements, the base and the switch, can thus easily be done because the switch is removable from the top.

Below the switch on top of the base, there can be arranged illumination means, such as a light or an LED, to prove the good functioning of the rocker switch unit and to indicate when the switch is in the ON-position. Therefore, the functioning and the ON-position of the rocker switch can be seen in the dark.

The advantages of the inventive rocker switch unit derive from the fact that the housing surrounds the rocker switch such that the rocker switch essentially determines the size of the housing and the entire unit. The fuses cannot be seen from the outside during normal operation. The user does not have to care about these fuses. However, the unit can be pulled off from an apparatus easily to change the fuse or even the entire unit, if necessary. This can be described in a manual of the apparatus. The rocker switch unit of the present invention can be used in any apparatus, in a network filter or as IEC entry plug.

BRIEF DESCRIPTION OF THE DRAWINGS

The invention will be better understood with the aid of the description of an embodiment given by way of example and illustrated by the figures, in which.

DETAILED DESCRIPTION OF POSSIBLE EMBODIMENTS OF THE INVENTION

Figure 1A:
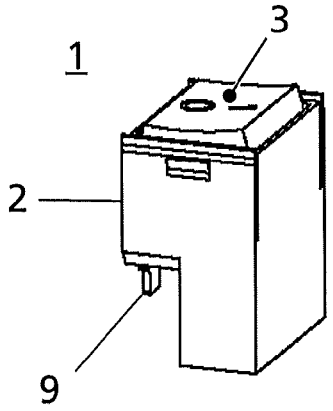
FIG. 1*a, b* shows a perspective view from of the rocker switch unit according to the invention.
Figure 1B:
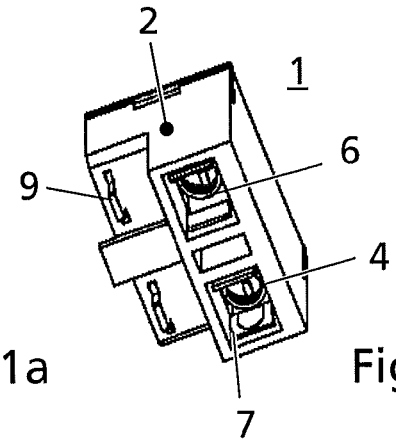
FIG. 1*c* shows a side view of the rocker switch unit according to the invention.

FIG. 1*a* shows a perspective of the rocker switch unit 1 with a switch body or housing 2. On top of the rocker switch unit 1 is provided a switch or rocker switch 3 which can be moved between two positions, one ON-position and one OFF-position. FIG. 1*b* shows a second view of the rocker switch unit 1 from the bottom of the rocker switch unit 1. On the bottom of the rocker switch unit 1 there is provided two blind holes 4 in which the fuse (FIGS. 11-13) can be entered. A first terminal 23 of the fuse 22 is connected inside of the blind hole 4 to a spring 6, while a second terminal 24 of the fuse 22 serves as a first connection terminal of the rocker switch unit 1 for connecting the rocker switch unit 1 with an external apparatus 25, when the rocker switch unit 1 is in use. As seen in FIG. 1*b* second connecting elements 9 are provided on the lower part of the bottom of the rocker switch unit 1. In this embodiment, the external end of the second connecting element 9 forms a second connection terminal for connecting the rocker switch unit 1 with the external apparatus.

Figure 1C:
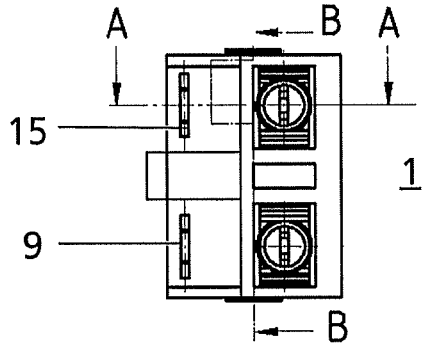

The housing 2 of the rocker switch unit 1 is formed with a step at the bottom, whereby; the blind holes 4 are arranged in the rear side of the step, and, the second connecting elements 9 are located on the step itself. The housing 2 consists of a single piece accommodating all essential parts of the rocker switch unit 1. The size of the rocker switch unit 1 corresponds essentially to the size of the switch 3 itself, which is greatly advantageous. FIG. 1*c* shows a view from below the rocker switch unit 1, in which the blind holes 4 and the second connecting elements 9 can be seen.

Figure 2A:
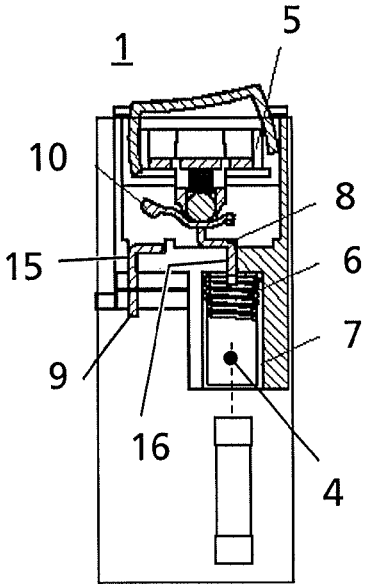
FIG. 2*a* shows a cross section view, of the rocker switch unit, taken along line A-A in the FIG. 1*c;*
Figure 2B:
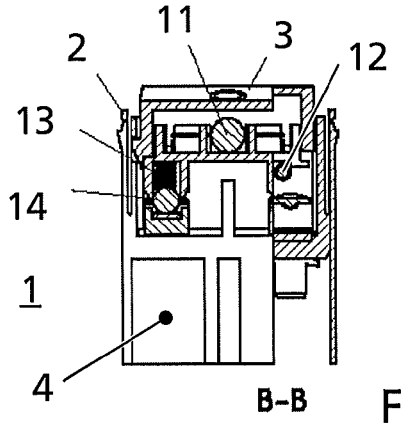
FIG. 2*b* shows a cross section view, of the rocker switch unit, taken along line B-B in the FIG. 1*c;*

To better understand the separate elements of the rocker switch unit 1, FIG. 2*a* provides a cross section view along line A-A in the FIG. 1*c*, through the rocker switch unit 1, and FIG. 2*b* shows a cross section view along line B-B in FIG. 1*c*, through the rocker switch unit 1.

Figure 4:
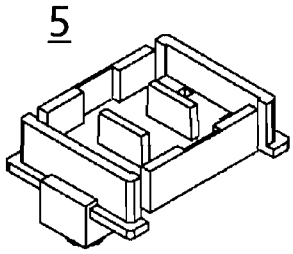
FIG. 4 shows a perspective view of an embodiment of a light base.
Figure 7:
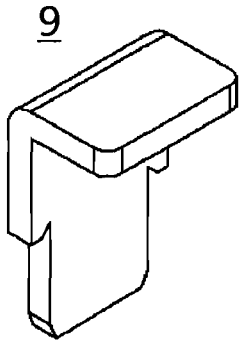
FIG. 7 shows a perspective view of a first connection element.
Figure 8:
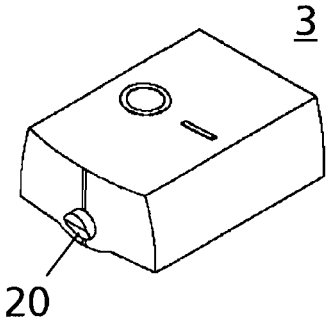
FIG. 8 shows a perspective view of an embodiment of the rocker switch.

As shown in FIG. 2*a*, below the switch 3 (detail see FIG. 8) inside the housing 2, there is a light base 5 (FIG. 4). The light base 5 transmits the movements of the switch and connects/disconnects the connecting elements 8 and 9 according to the ON- or OFF-position of the switch 3 via a switch connector 10. The light base 5 is supported on each side by a spring 13 and a ball bearing 14, which contacts and leads the switch connector 10. For this reason, two projections are provided on the lower side of the base 5, and the spring 13 is located between these two projections. Connecting elements 8 (FIG. 9) and 9 (FIG. 7), for connecting the rocker switch unit 1 to an external apparatus, are located inside the housing 2 on its inner bottom and extend through slits 15,16 which are provided in the bottom of housing 2.

Figure 6:
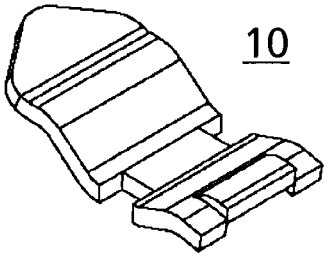
FIG. 6 shows a perspective view of switch connection element according to the invention.
Figure 9:
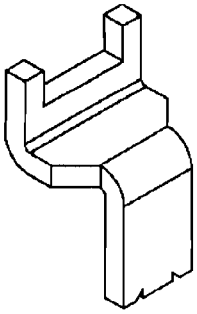
FIG. 9 shows a perspective view of a second connection element.

The first connecting element 8 shown in detail in FIG. 9 is connected by two horns to the switching connector 10 (FIG. 6), which has two corresponding recesses on each side in its middle section. The middle section of the connecting element 8 lies on the inner bottom of the housing 2 and one end of the connecting element 8 extends perpendicular to the middle section of connecting element 8 and is connected with the switching connector 10, while the other end extends perpendicular to the middle section of connecting element 8 in the other direction, through slits 16, and into the blind hole 4. This other end of the connecting element 8 connects to the first terminal 23 of the fuse 22 (FIGS. 11-13) by means of the spring 6. The second connecting element 9 has the form of an "L" whose lower part is lodged on the bottom, inside the housing, and whose other part extends outside of the housing through the slits 15, as visible in FIG. 1*a, b* and FIG. 2*a*. The light base 5 transmits the movements of the switch 3 and connects/disconnects the switching elements according to the ON- or OFF-position of the switch 3 via the switch connector 10 thus connecting/disconnecting both connecting elements 8, 9. When fuses are provided in both of the blind holes 4, there are connecting elements 8, 9 with a switching connector 10 arranged next to each other. For this reason, the light base 5 is guided on each side on a ball bearing 14 having a spring 13.

Figure 5:
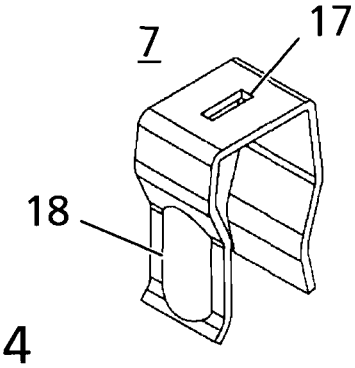
FIG. 5 shows a perspective view of an embodiment of a fuse connector.
Figure 10:
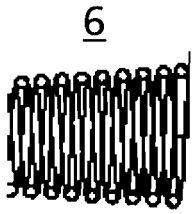
FIG. 10 shows a longitudinal section view of a spring within the fuse holder.

Inside each blind hole 4, a spring 6 and a fuse connector 7 are provided. FIG. 10 shows a longitudinal section view of the spring 6 which is provided within the fuse connector 7, and FIG. 5 shows an embodiment of a fuse connector 7. The fuse connector 7 has a form of a downturned U. The top is provided again with a slit 17 (FIG. 5), through which extends one end of the first connecting element 8 (see FIG. 2*a*). The end of the first connecting element 8 which extends through the slit 17 is connected to the spring 6 within the fuse connector 7. In one leg of the fuse connector 7 an aperture 18 is present which accommodates and holds the fuse. Both the spring 6 and depressions in both legs of the fuse connector 7 hold the fuse in place within the aperture 18. Due to flexibility of the fuse connector 7, the fuse can easily be removed or replaced. The spring 6 shown in FIG. 10 has two different diameters at opposite ends of the spring 6; it can thus be introduced easily into the fuse connector 7 and the blind hole 4.

In addition, as seen in FIG. 2*b*, below the switch 3, on top of the light base 5, there is provided an illumination means, such as a light 11 or an LED, arranged to show the good functioning of the rocker switch unit 1. The light 11 illuminates when the switch is in the ON-position, thus if the illumination of the light 11 can be used as an indication of when the switch is in the ON-position. The light 11 can be seen in the dark when it is illuminated. The resistor 12 is connected to the light 11.

Figure 3A:
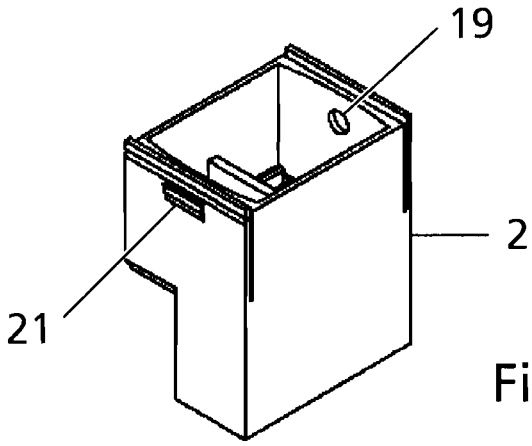
FIG. 3*a, b, c* show various perspective views of the housing of the rocker switch unit.
Figure 3B:
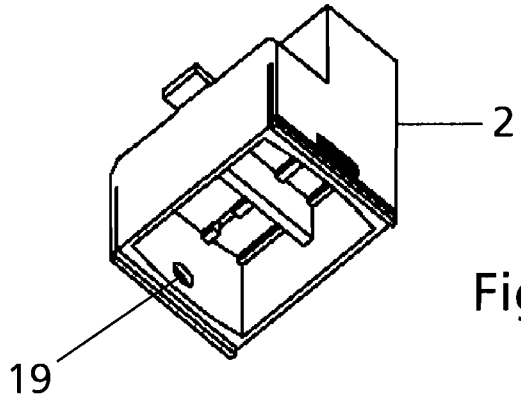
Figure 3C:
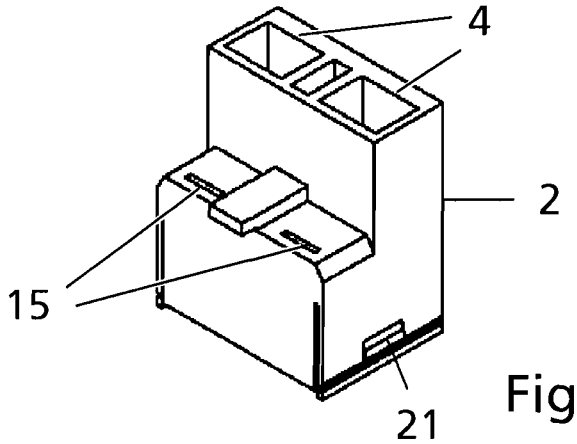

FIG. 3*a, b, c* show various perspective views of the housing 2 of the rocker switch unit 1. In one embodiment, the housing 2 consists of a single piece. The housing 2 provides on the upper side, where the switch 3 is lodged, on each lateral side two lateral walls separated by a slot and connected separately to the lower side of the housing 2. The switch 3 is pivotally fastened, at two opposed lateral sides, to the two inner walls of the housing 2, by means of knobs 20. The inner walls have corresponding circular apertures 19 which receive the knobs 20, to allow the switch 3 to pivot. Assembly of the inner parts including the connecting elements 8, 9, the base 5 and switch 3 can thus be done easily. The outer surface of the side walls of the housing each have a fastening element 21 for fastening the rocker switch unit 1 to any apparatus. Assembly of the inner parts of the rocker switch unit 1 including the connecting elements 8, 9, the base 5 and switch 3 can thus be done easily, because the switch 3 is removable from the top.

Advantageously, in the rocker switch unit 1, the housing 2 surrounds the rocker switch 3 such that the rocker switch 3 determines essentially the size of the housing 2 and the entire rocker switch unit 1. From the outer side during normal operation the fuses cannot be seen. A user does not have to care about these fuses. However, the rocker switch unit 1 can be pulled off from an apparatus easily, for replacing a fuse or even the entire rocker switch unit 1, if necessary. This can be described in a manual of the apparatus. The rocker switch unit 1 can be used in any apparatus, in a network filter or as IEC entry plug.

Figure 11:
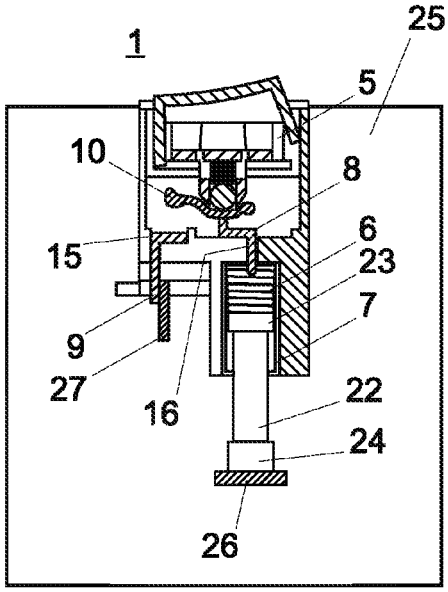
FIG. 11 shows cross section view of the rocker switch unit connected to an external apparatus.
Figure 12:
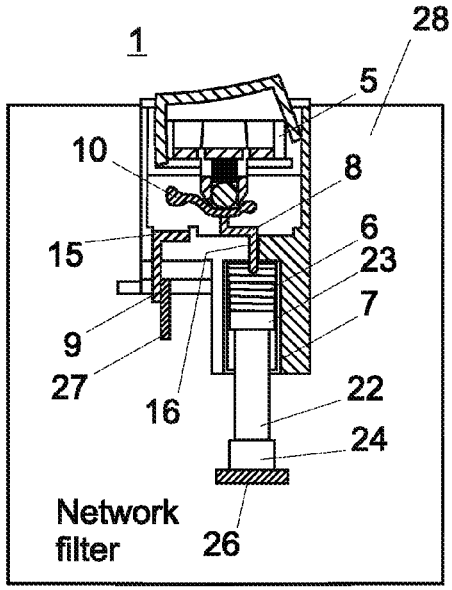
FIG. 12 shows cross section view of the rocker switch unit connected to a network connector.
Figure 13:
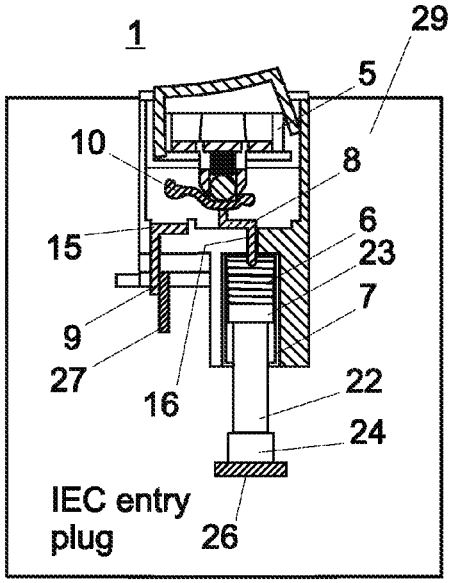
FIG. 13 shows a cross section view of the rocker switch unit connected to an IEC entry plug.

FIG. 11 shows the rocker switch unit 1 with the fuse 22 connected to an external apparatus 25. A second terminal 26 of the external apparatus is connected with the second terminal 24 of the fuse 22. A first terminal 27 of the external apparatus 25 is further connected with the second connecting element 9. FIG. 12 shows the rocker switch unit 1 connected to a network filter 28 as the external apparatus. FIG. 13 shows the rocker switch unit 1 connected to a IEC entry plug 29 as the external apparatus.

REFERENCE NUMBERS

1 Rocker switch unit
2 Housing, switch body
3 Rocker switch, switch knob
4 Blind hole in the housing 2
5 Light base
6 Spring for fuse connector 7
7 Fuse connector
8 Connecting element
9 Connecting element
10 Switch connector
11 Light
12 Resistor
13 Spring in the rocker switch unit 1
14 Ball bearing
15 Slit in housing 2 for connecting element 9
16 Slit in housing 2 for connecting element 8
17 Slit in fuse connector 7
18 Aperture
19 Circular aperture
20 Knobs
21 Fastening element
22 Fuse
23 First terminal of the fuse 21
24 Second terminal of the fuse 21
25 external apparatus
26 Second terminal of the external apparatus 25
27 First terminal of the external apparatus 25
28 network filter
29 IEC entry plug

The invention claimed is:

1. A rocker switch unit comprising:
a housing;
a rocker switch lodged pivotally in the housing having an ON-position and an OFF-position;
at least a fuse lodged in the housing;
at least a first connection terminal and a second connection terminal for connecting the rocker switch unit with an external apparatus, wherein the first connection terminal and second connection terminal are connected to each other by the fuse, when the rocker switch is in the ON-position, and the first connection terminal and the second connection terminal are disconnected when the rocker switch is in the OFF-position,
wherein the housing has at least one blind hole for accommodating the fuse, and wherein one terminal of the fuse corresponds to the first connection terminal for connecting the rocker switch unit with the external apparatus, and the one terminal of the fuse is arranged such that the one terminal of the fuse touches a terminal of the external apparatus, when the external apparatus is connected to the rocker switch unit.

2. The rocker switch unit of claim 1, wherein in the at least one blind hole, there is a spring connected to another terminal of the fuse.

3. The rocker switch unit of claim 1, wherein in the at least one blind hole a fuse holder is arranged.

4. The rocker switch unit of claim 1, wherein in the housing there are two blind holes next two each other for accommodating two fuses as two first connection terminals and two second connection terminals.

5. The rocker switch unit of claim 1, wherein the housing consists of a single piece accommodating on a first side the rocker switch and, accommodating on a second side, opposite to the first side, the at least one fuse in the blind hole.

6. The rocker switch unit of claim 1, wherein the housing is formed with a step, wherein in the step there is arranged the second connection terminal.

7. The rocker switch unit of claim 1, wherein the housing is formed with a step, wherein in the rear side of the step there is arrange the at least one blind hole.

8. The rocker switch unit of claim 1, wherein the second connection terminal comprises a second connecting element which has the form of an 'L' and is lodged with the lower part of the 'L' on the bottom inside the housing, the other part of the 'L' extending outside the housing through a slit provided in the housing, for connecting the rocker switch unit with the external apparatus.

9. The rocker switch unit of claim 1, wherein the other terminal of the fuse is connected inside the blind hole to a first connecting element which extends through an internal slit to the inner side of the housing.

10. A rocker switch unit comprising:
a housing;
a rocker switch lodged pivotally in the housing having an ON-position and an OFF-position;
at least a fuse lodged in the housing;

at least a first connection terminal and a second connection terminal for connecting the rocker switch unit with an external apparatus, wherein the first connection terminal and second connection terminal are connected to each other by the fuse, when the rocker switch is in the ON-position, and the first connection terminal and the second connection terminal are disconnected when the rocker switch is in the OFF-position, wherein the housing has at least one blind hole for accommodating the fuse, and wherein one terminal of the fuse corresponds to the first connection terminal for connecting the rocker switch unit with the external apparatus, wherein below the rocker switch is provided a base, which is guided on each side by a spring and a ball bearing, wherein the ball bearing connects the first connection terminal and the second connection terminal when the rocker switch is in the ON-position.

11. The rocker switch unit of claim 1, wherein the housing has on its upper side, where the rocker switch is pivotally lodged, two lateral walls on the lateral sides, the two lateral walls being separated by a slot and individually connected to the lower part of the housing.

12. The rocker switch unit of claim 11, wherein the rocker switch is pivotally fastened at opposite lateral sides of the rocker switch, to the two inner walls of the housing by means of knobs, whereby the inner walls of the housing have corresponding circular apertures.

13. The rocker switch unit of claim 1, wherein the rocker switch unit has lateral fastening elements provided on the housing to connect the rocker switch unit to the external apparatus.

14. The rocker switch unit of claim 1, wherein below the rocker switch there is provided illumination means.

15. The rocker switch unit of claim 1, wherein the housing surrounds the rocker switch such that the rocker switch determines essentially the size of the housing.

16. A use of the rocker switch unit of claim 1 in a network filter or as IEC entry plug.

* * * * *